United States Patent [19]

Brothers

[11] 4,211,169

[45] Jul. 8, 1980

[54] SUB PROJECTILE OR FLECHETTE LAUNCH SYSTEM

[75] Inventor: Jack Brothers, Succasunna, N.J.

[73] Assignee: The United States of America as represented by the Secretary of the Army, Washington, D.C.

[21] Appl. No.: 421,894

[22] Filed: Dec. 12, 1973

Related U.S. Application Data

[62] Division of Ser. No. 168,504, Jul. 30, 1971.

[51] Int. Cl.[3] ..... F42B 13/48

[52] U.S. Cl. ..... 102/67; 102/DIG. 2; 102/DIG. 7

[58] Field of Search ..... 102/67, 24 HL, DIG. 2, 102/DIG. 7, 7.2

[56] References Cited

U.S. PATENT DOCUMENTS

| | | | |
|---|---|---|---|
| 3,145,656 | 8/1964 | Cook et al. | 102/24 HL |
| 3,269,268 | 8/1966 | Gould | 102/7.2 |
| 3,637,449 | 1/1972 | Rizech, Jr. | 102/67 |
| 3,722,414 | 3/1973 | Talley | 102/67 |

*Primary Examiner*—Charles T. Jordan

*Attorney, Agent, or Firm*—Nathan Edelberg; Robert P. Gibson; A. Victor Erkkila

[57] ABSTRACT

An explosive flechette launching system which includes a central core explosive driver having stacked coaxially thereabout a plurality of disc plates which have layered and sandwiched therebetween for radial launching a multiplicity of flechettes. In one embodiment, the flechettes are oriented and pointed in a radial direction and each are provided with divergent tail piece which is releasably fitted into a mating recess in a driver piston abutting said explosive driver. The fin assembly is provided with a central bore and is slidably carried by the flechette body so that when disposed in said launching system, the fin assembly is positioned at the pointed end thereof and supported by wedge supports along the fins and intermediate the disc plates. The entire assembly is protectively encapsulated or covered with a thin membrane or skin. The explosive driver is designed to provide or generate a radial plane, high pressure wave for launching the flechettes. In the other embodiment the flechettes are oriented, between the plates, transverse to the direction of flight or side launch to provide a relatively large surface area against which the explosive energy can act.

6 Claims, 5 Drawing Figures

SUB PROJECTILE OR FLECHETTE LAUNCH SYSTEM

The invention described herein may be manufactured, used and licensed by or for the Government of governmental purposes without the payment to me of any royalty thereon.

This is a division of application Ser. No. 168,504 filed 30 July 1971.

BACKGROUND OF THE INVENTION

The present invention relates to dart-like projectiles such as flechettes and more particularly pertains to a physical structure for explosively, radially launching a plurality of flechettes employing a driver generator for propagating a radially directed plane wave.

In the field of launching flechettes, it has been the general practice to employ pneumatic, mechanical and explosive drivers for imparting a high velocity to the projectiles. However, such launch systems have proved unsatisfactory in that the mechanical and pneumatic systems could not provide a sufficiently high launch velocity to make the flechette useful for the purpose intended. On the other hand, explosive lauching from conventional ammunition items resulted in severe and intolerable damage to the flechette and fin assembly. Additionally, such form of lauching necessitates side or fin first launch for economical packaging in round carriers. The present invention overcomes these problems and solves a long existing need.

SUMMARY OF THE INVENTION

The general purpose of this invention is to provide an explosive flechette launch system that has all the advantages of similarly employed prior art devices and has none of the above described limitations and disadvantages. To attain this, the present invention provides a unique structural arrangement wherein the flechettes are releasably supported and sandwiched between pairs of disc plates. A central coaxial radial, plane wave, explosive driver is disposed axially of said plates and flechettes and extends between the outer plates. The flechettes are oriented radially or laterally and when radially directed are provided with a fin assembly slidingly and coaxially mounted on the body thereof with a rear enlarged portion for firmly holding said fin assembly after launch and for providing a surface area upon which the propagating wave energy will act.

An object of the present invention is to provide an efficient, reliable, economically feasible, explosive launch system for sub projectiles, such as flechettes without damage thereto.

Another object is to provide a flechette explosive launch system wherein the flechettes are radially launched when initially oriented either lateral to or pointed in the direction of flight.

Still another object is to provide a novel flechette which may be radially launched in the direction of flight at a maximum velocity without fin damage.

A further object is to provide a high energy radial plane wave explosive generator capable of lauching a plurality of radially support flechettes.

Other objects and many of the attendant advantages of this invention will be readily appreciated as the same becomes better understood by reference to the following detailed description when considered in connection with the accompanying drawings wherein.

DESCRIPTION OF THE PREFERRED EMBODIMENTS

Figure 1:
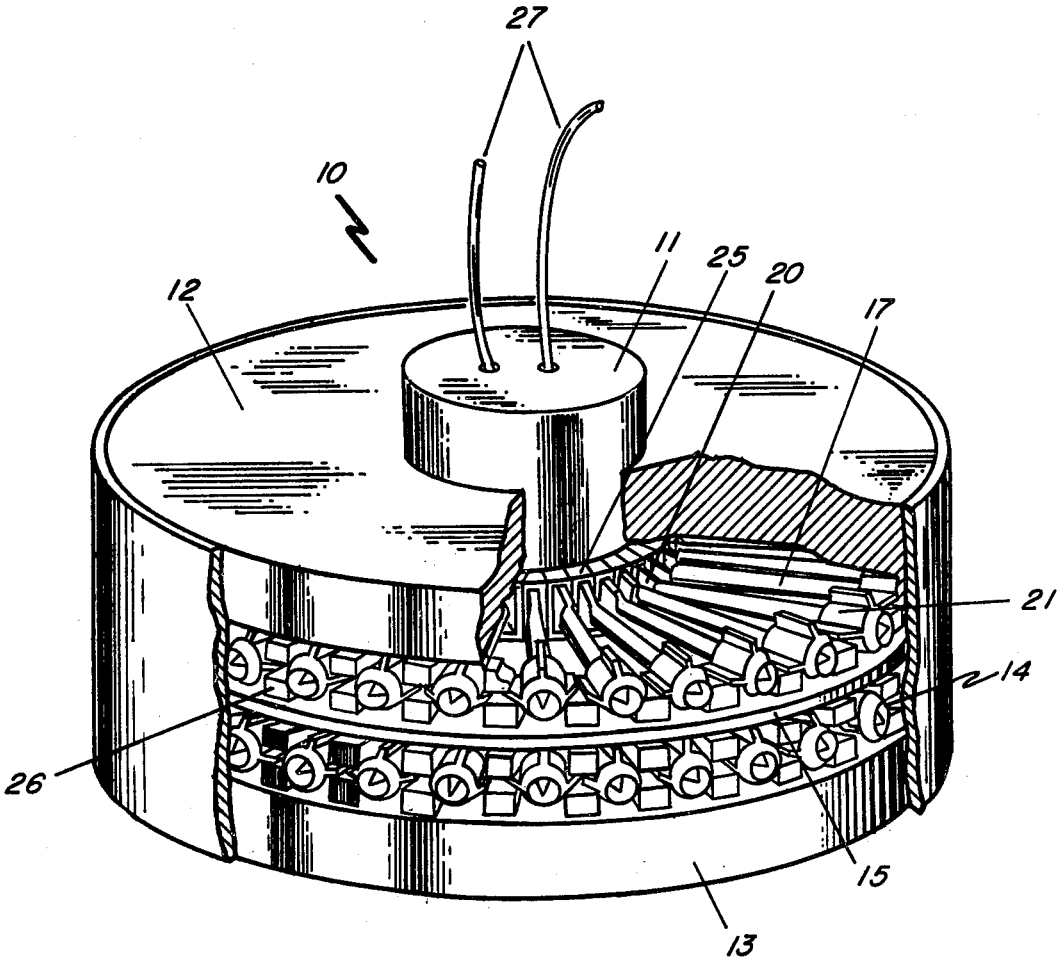
FIG. 1 is a perspective of an embodiment made in accordance with the principle of the instant invention.

In the illustrated embodiment of FIG. 1 the flechette explosive launcher 10 includes a central circular cylindrical driver explosive 11 about which are longitudinally disposed an upper 12 and bottom plate-like disc 13. Intermediate these plates and sandwiched therebetween are alternate layers of flechette assemblies 14 and spacer disc plates 15. All the discs are circular and have an aperture therethrough, through which the driver 11 passes so as to form a structure about the driver. Although only two layers have been shown, it is clear that as many as necessary or desired can be assembled.

Figure 3:
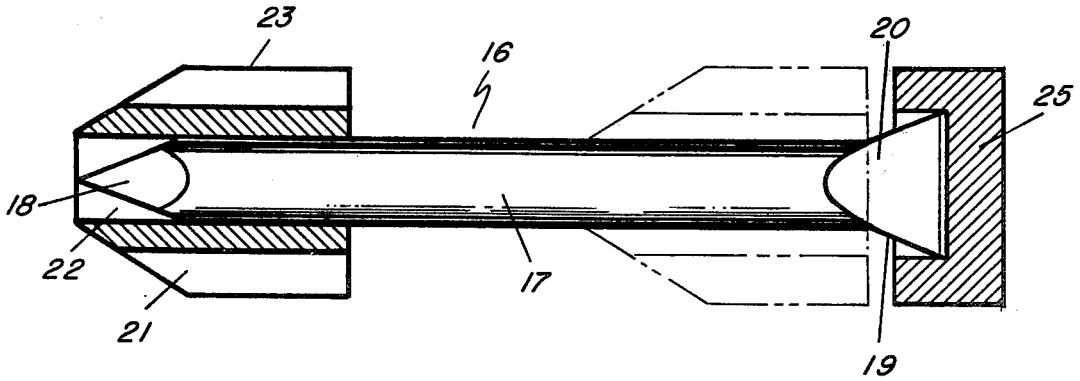
FIG. 3 is a cross-section of the flechette with the pusher piston.

The flechette 16 illustrated in FIG. 3, essentially includes a circular elongated cylindrical body 17 whose forward end portion is formed with a sharp pointed tip 18. The opposite end thereof is formed with an outwardly and rearwardly divergent tail 19 that has flattened side walls 20. Disposed about the flechette body for sliding movement therealong is a fin assembly 21 which is provided with a central aperture 22 and four laterally extending fins 23. Since the fin assembly 21 can slide lengthwise of the body, then as the flechette body accelerates forwardly, the fin assembly will in relation to the body, move rearwardly as indicated. With a sudden, rapid acceleration, the fin assembly will move relative to the body and becomes impaled on the tail portion due to its divergent configuration and thereafter fixedly secured thereto. By fabricating the entire fin and flechette assembly of a plastic material the inherent distortion of such materials lends itself to the operation above described.

Figure 2:
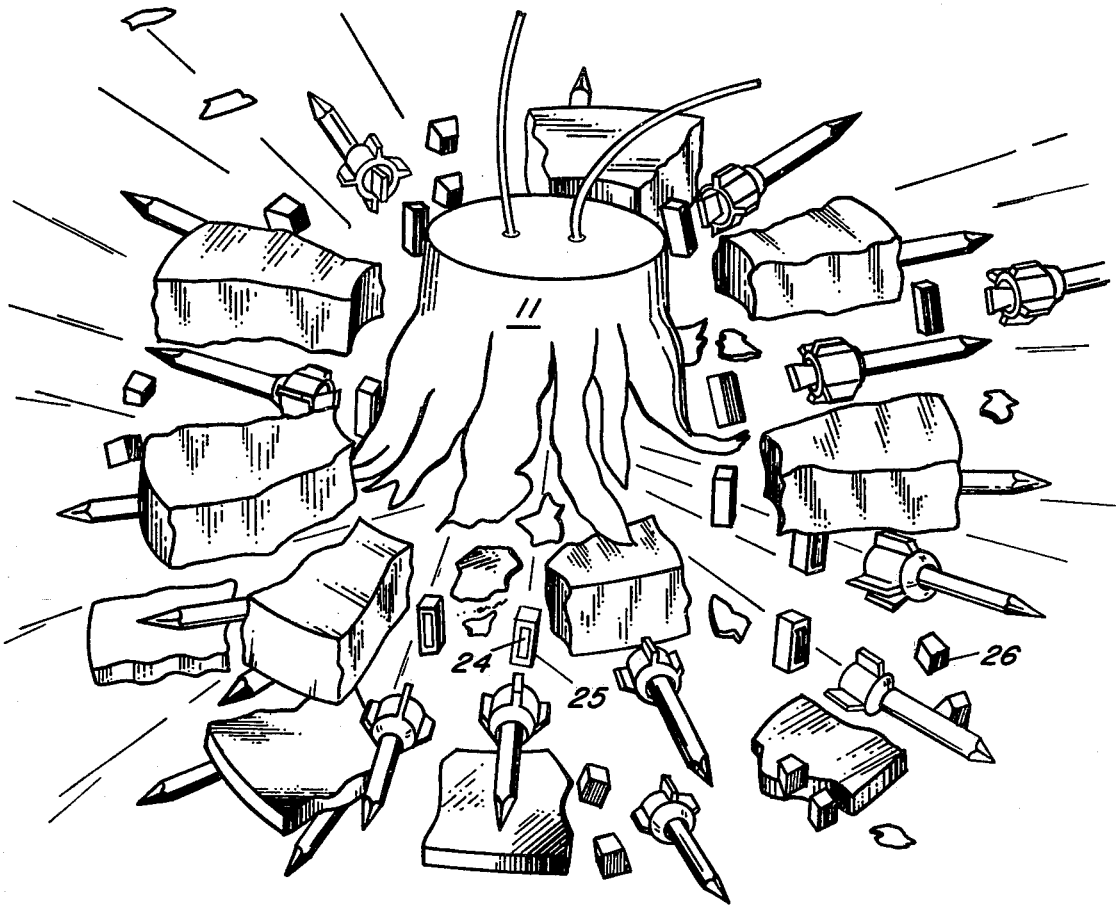
FIG. 2 is a perspective of the embodiment of FIG. 1 immediately subsequent to launch.

The flechettes are disposed within the assembly in an outwardly directed, radially oriented position with the fin assembly 21 proximate and coaxial with the pointed end and the flattened tail portion 20 inserted into a mating recess 24 (also see FIG. 3) in a piston pusher block 25. The pusher block is in abutting relation with the peripheral surface of the explosive driver 11 and supports the rear of the flechette. Forward support is provided by pairs of wedge support blocks 26 intermediate adjacent flechettes. The fins of each flechette rest thereon and a like block pair disposed to rest on the upper fin surface and about the lower face of the plate immediately thereabove. Thus the flechettes are releasably supported and pointed in the ultimate direction of flight. These wedge supports could be stamped out or united and combined to reduce the overall number and of almost any relatively rigid material. It is clear from the foregoing that the function of the wedges could equally well be performed by forming the plates with radial recesses for supporting and guiding the flechettes or any other releasable support means. The entire launch assembly is surrounded, encapsulated or encased in skin, membrane or sleeve of suitable plastic or thin metal for containing and protecting the components. The explosive driver may be of any suitable explosive or propellant such as sheet explosive, composition C-4 or preferably a propellant which exhibits no brisance but provides energy in the form of a high pressure low velocity wave. Initiating means, such as wires 27 are provided to detonate the driver although fuzes of various types could be substituted dependent on the ultimate purpose of the launch system. These means include electrical, chemical, mechanical, remote, self-contained, time controlled and environmental sensors or other suitable means for functioning the explosive driver. In operation the device is delivered to its operational destination and thereafter initiated. When the driver bursts it rapidly expands radially and imparts a high thrust to the pusher piston against its relatively large rear surface. This energy is transmitted to the flechette via its flattened rear edge face disposed within the piston notch. The flechette body then travels through the stationary fin assembly which is impaled on the taper of the flattened end of the body and both proceed in the direction of flight locked together. Since the pusher piston has a higher aerodynamic drag than the assembled flechette it will lose contact therewith soon after the thrust force terminates. FIG. 2 shows the action immediately after the explosive driver has been detonated. The plates serve to confine the energy therebetween and direct it a generally radial direction for proper launching. The device as disclosed is of the antipersonnel type in the form of a land mine but can also be used for air bursts, jump-up device, booby traps, etc.

Figure 4:
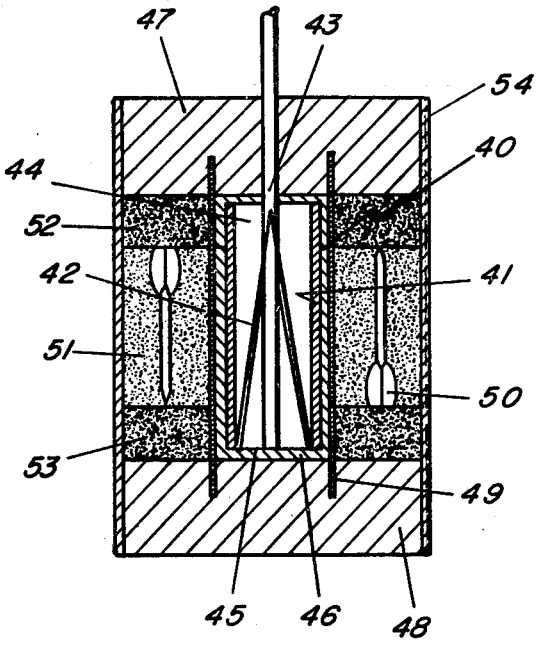
FIG. 4 is a perspective of another embodiment made in accordance with the principle of this invention and, also a cross-sectional view of a radial plane wave explosive generator.

Illustrated by way of FIG. 4 is one form of a radial plane wave generator 40 which is in the shape of a right circular cylinder. The volume thereof is divided into three major sectors a first outer annular cylinder 41, an inner right cone 42 which is designated as a waveshaper and the volume intermediate the first two volumes. The point of explosive initiation is at the apex 43 of the cone. The first two volumes being filled with a suitable explosive such as Composition C-4 (which consists of 91.0% cyclotrimethylenetrinitramine (RDX), 2.1% polyisobutylene, 1.6% motor oil and 5.3% di-(2-ethylhexyl) sebacate) while the intermediate volume 44 is air or some inert material. The explosive material and/or the inert material are selected such that their respective detonation wave velocities provide a wave transit time from the point of initiation 43 to the base of the cone 45 which is equal to that from the point 43 to the inner peripheral surface 46 of the annular cylinder 41. The conical waveshaper in conjunction with the cylindrical configuration serves to produce a radially directed right circular cylindrical plane wave. The plane wave generator 40 is entirely contained in a jacket 46 which is axially disposed between a pair of plates 47 and 48 and supported by a cylindrical sleeve 49 which extends into both plates. Disposed circumferentially about the plane-wave generator or driver 40 in a lateral orientation, pointed in either direction, are a multiplicity of flechettes 50 which may be imbedded in an inert, compatible supporting matrix 51 such as expanded foam. Where desired, upper 52 and lower 53 annular supports are provided. A casing 54 as described in conjunction with the formerly described embodiment surrounds the structure. It should be noted that standard flechettes are used and the side or lateral thrust from the generator is applied to the body of the flechette which effectively represents a relatively large area. Almost immediately after the launch the aerodynamic forces acting on the flechette due to the fins turn the flechette to point and be properly directed in the forward direction of flight.

Figure 5:
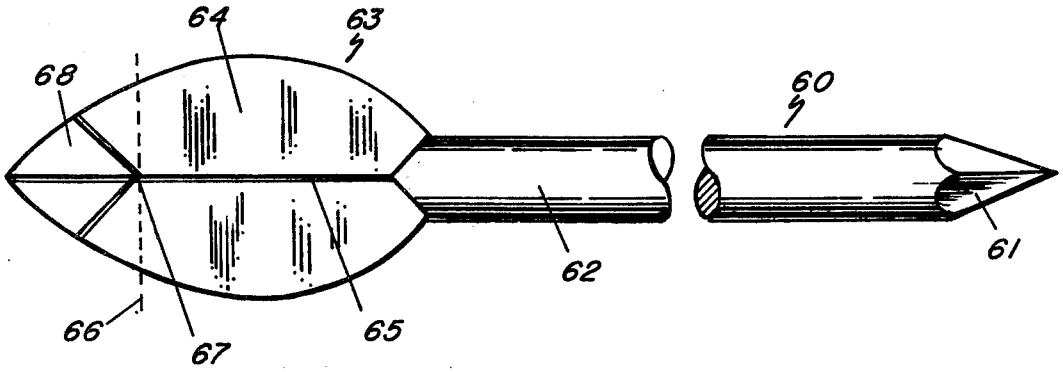
FIG. 5 is a cross-sectional view of an improved flechette.

An improved flechette design is illustrated in FIG. 5 wherein the device 60 is generally of the standard configuration including a forward pointed end 61 and a thin elongated body 62 from which extends as intergral fin assembly 63. The fins 64 themselves are thin, sheet-like elements which are perpendicular to each other and joined along an axial line 65. In the standard design the fins terminate in a transverse plane (represented by dotted line 66) with the fins joined at a point 67. Since the fins are structurally, thin weak elements, upon launch a portion of the thrust is borne by the rear edge end face of each fin, and produces a distortion or twist in the fin itself. The fin upon being distorted, functions as a rudder and results in a flight pattern which is not radially linear thus defeating the intended purpose of the flechette. By extending the fins rearwardly and physically making them integral thereat as by nub 68 that is rearwardly convergent or pointed the fins are strengthened and fixedly secured. The flechette is aerodynamically (steamline) shaped which shape is not altered by the rear nub and the laminar air flow during flight remains undisturbed.

It should be understood, of course, that the foregoing disclosure relates to only preferred embodiments of the invention and that numerous modifications or alterations may be made therein without departing from the spirit and the scope of the invention as set forth in the appended claims.

I claim

1. An explosive launcher for and including flechettes which comprises:

means for explosively generating a radially directed explosive plane wave including selective initiating means;

a plurality of spaced apart plate members extending radially from and coaxial with said generating means;

each of said flechettes comprising a thin elongated body having a pointed forward end and a plurality of fins at the rear end, and said flechettes being disposed about said plane wave generating means and positioned intermediate adjacent of said plates, said flechettes being oriented in a direction transverse to their intended direction of flight; and means for supporting said plates and said flechettes.

2. The launcher according to claim 1, wherein the means for supporting said flechettes comprises a matrix encasing said flechettes.

3. The launcher according to claim 2, wherein said matrix is an expanded foam.

4. An explosive, radially directed plane wave generator which comprises:

a closed hollow circular cylinder having coaxially disposed therein, a central right angle cone of an explosive material, a right circular cylinder of said explosive material disposed coaxially with said cone and abutting the base thereof, and means for initiating said explosive extending lengthwise and centrally of said cone.

5. The generator according to claim 4 wherein the space intermediate said cone and cylinder is filled with an expanded foam.

6. The generator according to claim 4 wherein said explosive material consists of 91.0% cyclotrimethylenetrinitramine, 2.1% polyisobutylene, 1.6% motor oil and 5.3% di-(2-ethylhexyl) sebacate.

* * * * *